US006969544B2

(12) United States Patent
Semba

(10) Patent No.: US 6,969,544 B2
(45) Date of Patent: Nov. 29, 2005

(54) SHEET ROLL PRODUCING APPARATUS, SHEET ROLL DISCHARGING APPARATUS, AND CORE SUPPLYING APPARATUS

(75) Inventor: Yoshikimi Semba, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 93 days.

(21) Appl. No.: 10/417,091

(22) Filed: Apr. 17, 2003

(65) Prior Publication Data

US 2003/0207100 A1 Nov. 6, 2003

Related U.S. Application Data

(62) Division of application No. 09/874,229, filed on Jun. 6, 2001, now Pat. No. 6,592,698, which is a division of application No. 09/112,240, filed on Jul. 9, 1998, now Pat. No. 6,269,859, which is a division of application No. 08/568,364, filed on Dec. 6, 1995, now Pat. No. 5,810,966.

(30) Foreign Application Priority Data

Dec. 8, 1994 (JP) ..... 6-304893
Dec. 26, 1994 (JP) ..... 6-322312
Jan. 10, 1995 (JP) ..... 7-2179

(51) Int. Cl.[7] ..... B41M 5/40
(52) U.S. Cl. ..... 428/32.75; 428/32.76; 428/32.77
(58) Field of Search ..... 428/32.75, 32.76, 428/32.77

(56) References Cited

U.S. PATENT DOCUMENTS

| | | | | |
|---|---|---|---|---|
| 2,430,075 | A | 11/1947 | Olson | 242/533.7 |
| 2,467,555 | A | 4/1949 | Hombostel et al. | 242/533.3 |
| 3,393,881 | A | 7/1968 | Nash | 242/533.7 |
| 3,399,096 | A | 8/1968 | Ranger | 156/511 |
| 3,869,046 | A | 3/1975 | Gerhart | 242/533.1 |
| 5,352,319 | A | 10/1994 | Ishizu et al. | 156/446 |
| 5,413,656 | A | 5/1995 | Kuhnhold et al. | 156/187 |

FOREIGN PATENT DOCUMENTS

| | | |
|---|---|---|
| CA | 2 025 472 | 3/1991 |
| GB | 2 257 931 | 1/1993 |

*Primary Examiner*—Bruce H. Hess
(74) *Attorney, Agent, or Firm*—Parkhurst & Wendel, L.L.P.

(57) ABSTRACT

A method of forming sheet rolls made of a heat transfer recording sheet having a transfer ink layer on a surface of a base by winding the recording sheet around the outer peripheries of a plurality of cores. The method includes supplying a web heat transfer recording sheet, cutting a portion thereof corresponding to a region between two adjacent sheet rolls to form cut ends; placing a non-adhesive waste sheet and a pair of adhesive tapes attached to the waste sheet ends between the transfer recording sheet, the tapes having an adhesive portion, an outside-exposed portion, and a portion attached to a cut end of the recording sheet, winding the sheet around a core outer periphery, positioning the waste sheet between winding apparatus and a discharging portion, and cutting the waste sheet so positioned.

3 Claims, 17 Drawing Sheets

SHEET ROLL PRODUCING APPARATUS, SHEET ROLL DISCHARGING APPARATUS, AND CORE SUPPLYING APPARATUS

This is a Division of application Ser. No. 09/874,229 filed Jun. 6, 2001 now U.S. Pat. No. 6,592,698 which in turn is a division of application Ser. No. 09/112,240 filed Jul. 9, 1998 (now U.S. Pat. No. 6,269,859) which in turn is a division of application Ser. No. 08/568,364 filed Dec. 6, 1995 (now U.S. Pat. No. 5,810,966).

BACKGROUND OF THE INVENTION

1. Field of the Invention

The present invention relates to a sheet roll producing apparatus for forming a sheet roll by winding a heat transfer recording sheet, mainly used in forming bar codes, around an outer periphery of a core, and a core supplying apparatus.

2. Related Background Art

The heat transfer recording sheet is presently used for forming bar codes. This recording sheet is also called a donor, wherein a hot melt ink layer consisting of a binder of wax, resins, etc., and a color agent is laid on one surface of a thin, plastic film base, for example, of polyester. The ink layer of the recording sheet is overlaid on paper, and the back face of the recording sheet is heated by a heating means such as a thermal head to transfer ink to the paper, thereby effecting printing.

The heat transfer recording sheet as described above is wound up in a roll form around a core, and the sheet roll is used in bar code forming apparatus. Here, the heat transfer recording sheet is wound around the outer periphery of the core to form a sheet roll. The sheet roll of this type is formed in the following manner by a winding apparatus. First, a plurality of cores are arranged at equal intervals on a shaft, and the shaft is rotated by a rotation drive portion to wind the heat transfer recording sheet around the outer peripheries of the cores, thus obtaining sheet rolls. In this case, the cores need to be supplied to the shaft and the plurality of cores need to be arranged at equal intervals on the shaft, but a core supplying apparatus capable of meeting those needs has yet to be developed.

SUMMARY OF THE INVENTION

The present invention has been accomplished taking account of the above points, and an object of the present invention is to provide a sheet roll producing apparatus and a core supplying apparatus which can supply a plurality of cores to a shaft and which can surely set the cores at constant intervals on the shaft.

A first feature of the present invention is a sheet roll producing apparatus for producing a sheet roll by winding a heat transfer recording sheet, obtained by forming a transfer ink layer on one surface of a base, around an outer periphery of a core, comprising: a supplying apparatus for supplying a weblike heat transfer recording sheet;Ca waste sheet part forming apparatus, disposed on a downstream side of the supplying apparatus, for cutting a portion corresponding to a region between sheet rolls in the weblike heat transfer recording sheet and interposing a waste sheet part having a pair of adhesive portions located on both cut end sides, between the cut ends of the heat transfer recording sheet; and a winding apparatus disposed on a downstream side of the waste sheet part forming apparatus and having a winding portion for winding the heat transfer recording sheet around an outer periphery of a core to form a sheet roll, a discharging portion for holding the sheet roll thus formed before discharging it, and a cutting portion, provided between the winding portion and the discharging portion, for cutting the waste sheet part extending between the winding portion and the discharging portion.

A second feature of the present invention is a sheet roll discharging apparatus for discharging a sheet roll formed by winding up a heat transfer recording sheet, obtained by forming a transfer ink layer on one surface of a base, around an outer periphery of a core, comprising:Ca cantilever shaft supporting a plurality of wound sheet rolls and having a rotation drive portion; a tray provided below the cantilever shaft; and a stopper for pushing a rotation-drive-portion-side end of a sheet roll located on a rotation drive portion side out of said plurality of sheet rolls.

A third feature of the present invention is a core supplying apparatus for supplying a core to a winding apparatus for forming a sheet roll by winding a heat transfer recording sheet, obtained by forming a transfer ink layer on one surface of a base, around an outer periphery of a core, comprising: a cantilever shaft supporting a plurality of cores and having a rotation drive portion; a tray disposed below the cantilever shaft so as to be movable up and down and to move in a direction of an axis of the cantilever shaft as carrying a plurality of cores; andCcore stoppers provided at constant intervals corresponding to the cores on the tray and pushing the cores when the cores on the tray are made to be set on said cantilever shaft from the free end of the cantilever shaft.

According to the first feature, the weblike heat transfer recording sheet is supplied from the supplying apparatus, the waste sheet part forming apparatus cuts the portion corresponding to the region between sheet rolls in the heat transfer recording sheet, and the waste sheet part having a pair of adhesive portions located on the both cut end sides is provided between the cut ends. Then the heat transfer recording sheet is fed to the winding apparatus, and the winding portion in the winding apparatus winds up the heat transfer recording sheet around the outer peripheries of cores to form sheet rolls. The sheet rolls thus formed are transferred to the discharging portion and cores are supplied to the winding portion. The cutting portion cuts the waste sheet part extending between the winding portion and the discharging portion, the downstream adhesive portion out of the pair of adhesive portions is attached to the outer periphery of a sheet roll in the discharging portion and the upstream adhesive portion is attached to the outer periphery of a core.

According to the second feature, the tray with the stopper attached thereto ascends relative to the cantilever shaft supporting the plurality of wound sheet rolls. When the tray next moves to the free end side of the cantilever shaft, the stopper pushes the rotation-drive-portion-side end of a sheet roll on the rotation drive portion side. By this, the stopper pushes all sheet rolls to the free end side of the cantilever shaft, whereby the sheet rolls are successively mounted onto the tray.

According to the third feature, the tray moves in the direction of the axis of the cantilever shaft from the free end side of the cantilever shaft to the rotation drive portion side, whereby the plurality of cores mounted on the tray are successively set on the cantilever shaft from the free end thereof. In this case, the cores are pushed by the core stoppers provided at equal intervals on the tray, so that the cores can be arranged at constant intervals with accuracy on the cantilever shaft by the core stoppers.

DESCRIPTION OF THE PREFERRED EMBODIMENTS

Sheet Roll Producing Apparatus

Figure 1:
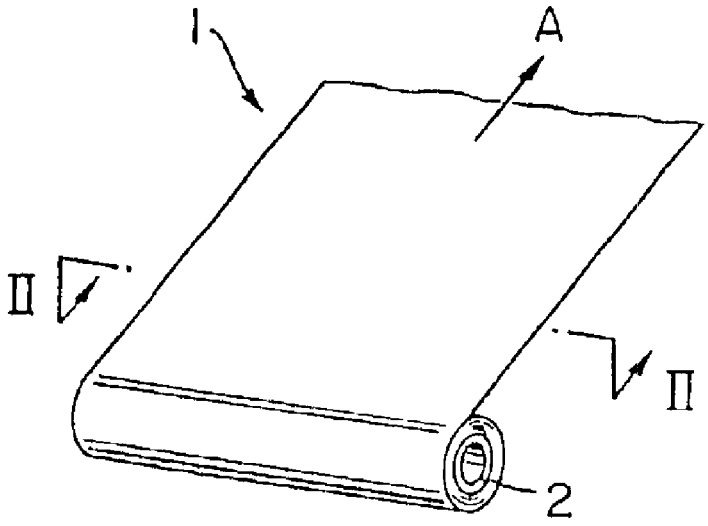
FIG. 1 is a perspective view to show a heat transfer recording sheet.

First, the heat transfer recording sheet is described referring to FIG. 1. As shown in FIG. 1, the heat transfer recording sheet drawn out from a core 2 is pulled in the direction of arrow A and a small amount of sheet remains on the core 2 side. Here, the core 2 is a roll shaft for the heat transfer recording sheet, which is made of plastic or paper.

Figure 2:
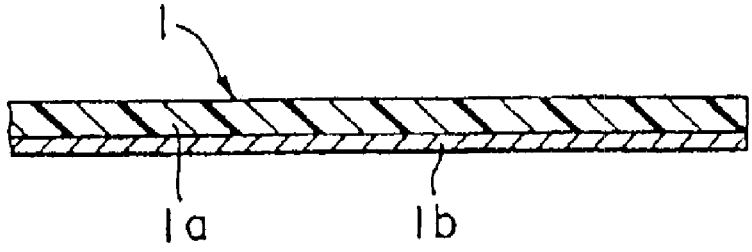
FIG. 2 is a cross section along line II—II in FIG. 1.

As shown in FIG. 2, which is a cross section along line II—II in FIG. 1, the heat transfer recording sheet 1 has a base film 1*a*, and a hot melt ink layer 1*b*, provided on one face of the base film 1*a*, for recording of copy as aimed, by heat transfer. Among them, the base film 1*a* is made of a plastic such as polyester, polypropylene, cellophane acetate, or polycarbonate, or a paper such as condenser paper or paraffin paper. Among them a polyester base film 1*a* is preferred. The hot melt ink layer 1*b* is made of a mixture of a known pigment, a synthetic resin, and a wax. This hot melt ink layer has a thickness of 3 to 8 microns.

Figure 3:
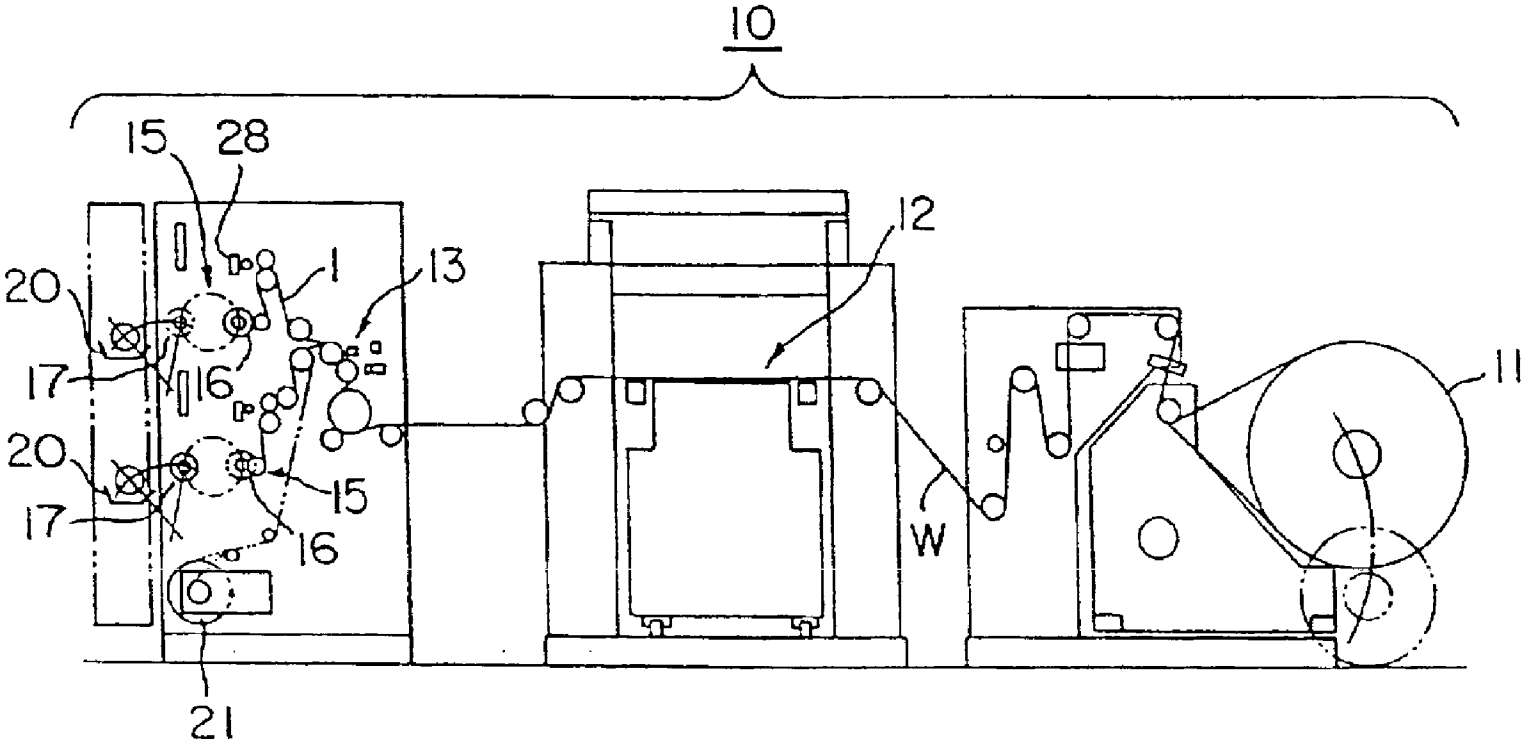
FIG. 3 is a schematic drawing to show a sheet roll producing apparatus according to the present invention.

The sheet roll producing apparatus is next described referring to FIG. 3 to FIG. 10B. First, as shown in FIG. 3, the sheet roll producing apparatus 10 is provided with a supplying apparatus 11 for supplying a weblike heat transfer recording sheet W. Also, a waste sheet part forming apparatus 12 is disposed on the downstream side of the supplying apparatus 11. This waste sheet part forming apparatus 12 is arranged to cut a part corresponding to a region between sheet rolls 26 as detailed later in the weblike heat transfer recording sheet W and to interpose a waste sheet 30 (FIGS. 10A and 10B) between cut ends of the heat transfer recording sheet W.

Figure 4:
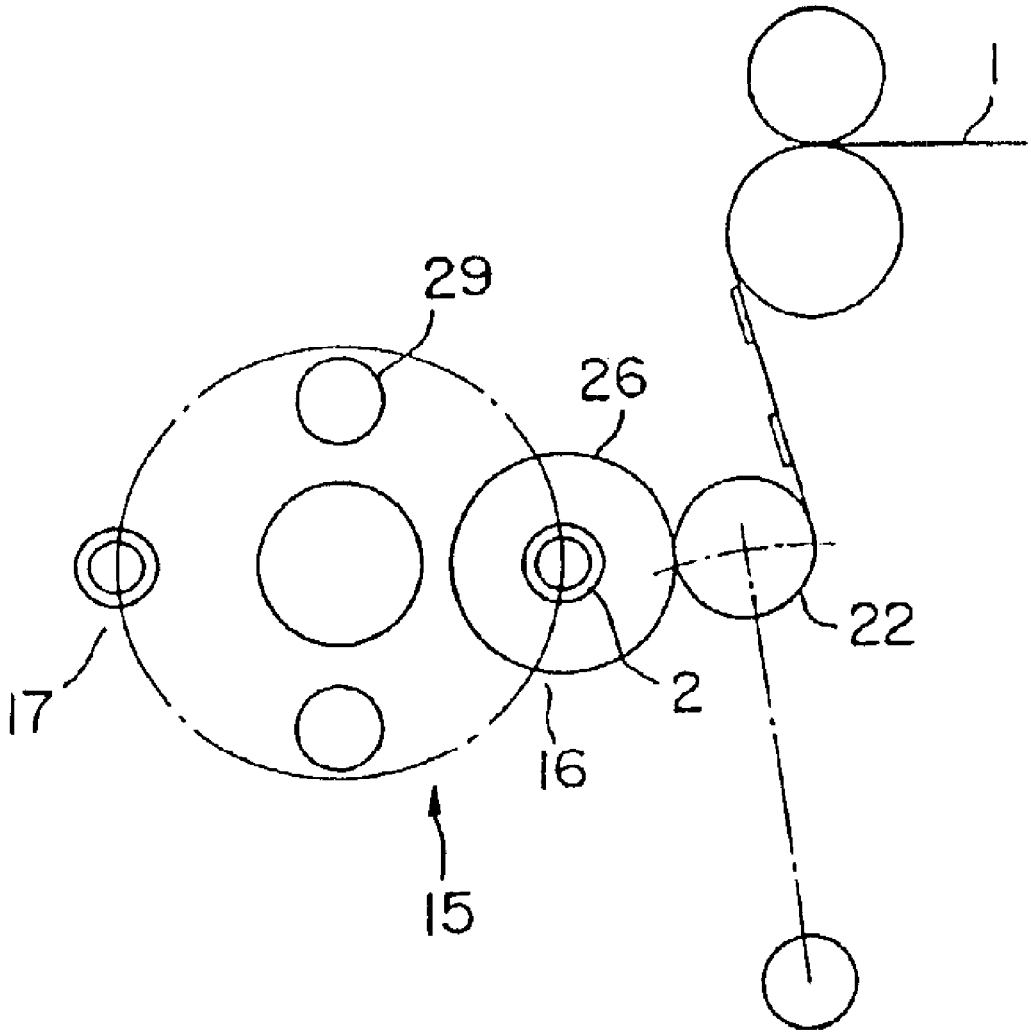
FIG. 4 is a drawing to show the operation of a winding apparatus in the sheet roll producing apparatus.

On the downstream side of the waste sheet part forming apparatus 12 there is a slit apparatus 13 provided for cutting the weblike heat transfer recording sheet W in the longitudinal direction into a plurality of strips, and on the downstream side of the slit apparatus 13 there are winding apparatus 15 arranged in two steps up and down for forming sheet rolls 26 (FIG. 4). Among them, for example, the winding apparatus 15 in the upper step is arranged to wind up strips of the heat transfer recording sheet 1 in odd columns, out of the heat transfer recording sheets 1 after being separated in the longitudinal direction, around outer peripheries of cores 2, and the winding apparatus 15 in the lower step is arranged to wind up strips of the heat transfer recording sheet 1 in even columns around outer peripheries of cores 2. Further, each winding apparatus 15 has a winding portion 16 for winding up the heat transfer sheets 1 separated in the longitudinal direction around the outer peripheries of cores 2 to form sheet rolls 26, and a discharging portion 17 for holding the sheet rolls 26 thus formed before discharging them. On the downstream side of each winding apparatus 15 there is provided a discharge tray 20 for receiving the sheet rolls 26 discharged from the discharging portion 17. Further, below the winding apparatus there is a disposal sheet winding apparatus 21 provided for winding both side portions cut off in the longitudinal direction by the slit apparatus 13 from the weblike heat transfer recording sheet W. Conveying rollers provided between the waste sheet part forming apparatus 12 and the winding apparatus 15 are, for example, silicone rubber rollers to prevent sticking tape 31, as described later, from adhesive thereto.

Figure 10A:
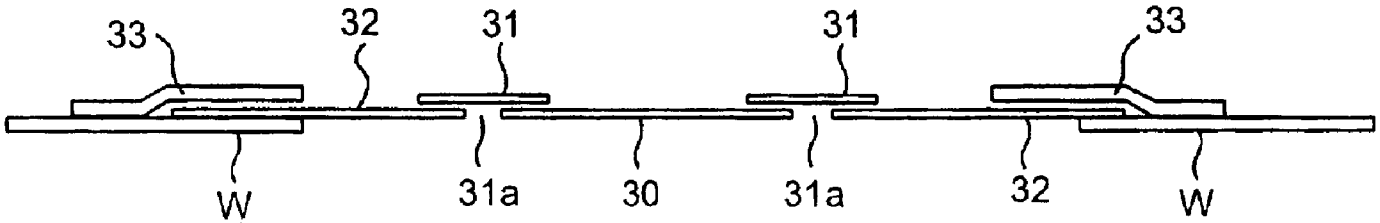
FIGS. 10A and 10B are drawings to show a waste sheet provided in a waste sheet part forming apparatus.
Figure 10B:
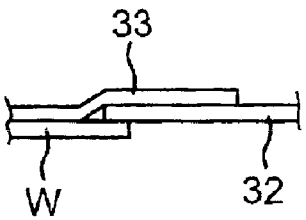

A waste sheet 30 provided by the sheet part forming apparatus 12 is next detailed referring to FIGS. 10A and 10B. As shown in FIG. 10A, the weblike heat transfer recording sheet W is cut in the portion corresponding to the region between the sheet rolls 26 in the waste part forming apparatus 12, as described above, and the cut ends of the heat transfer recording sheet W thus cut are slightly separated from each other. Next, between the heat transfer recording sheets W there are a lead sheet 32, an adhesive tape 31, a transparent waste sheet 30, an adhesive tape 31, and a lead sheet 32 attached in order from left to right in FIG. 10A. The pair of lead sheets 32 are attached with respective adhesive tapes 33 to the heat transfer recording sheet W (FIG. 10B).

The pair of adhesive tapes 31 each have their adhesive portions 31*a* exposed downward between the waste sheet 30 and the lead sheet 32. The left adhesive portion 31*a* of the waste sheet 30 is for terminating a sheet roll 26 after being wound, and the right adhesive portion 31*a* of the waste sheet 30 is for sticking the distal end of the heat transfer recording sheet 1 to the core 2.

The winding apparatus 15 is next described in further detail referring to FIG. 4 to FIG. 9. FIG. 4 to FIG. 9 are drawings to show the winding apparatus 15. A retaining roller 29 is provided between the winding portion 16 and the discharging portion 17, and a nip roller 27 for holding the heat transfer recording sheet 1 between the nip roller 27 and the retaining roller 29 is provided above the retaining roller 29 so as to be movable up and down. Guide plates 25*a*, 25*b* are provided on either side of the retaining roller 29, and a stop plate 24 for stopping the heat transfer recording sheet with the guide plate 25*b* between them is attached to the nip roller 27.

Further, a cutting portion 28 having a cutter 28*a* is provided between the winding portion 16 and the retaining roller 29 so as to be movable up and down. Below the cutting portion 28 there is provided a press portion 28*b* for attaching an adhesive tape 31 to the core 2 introduced to the winding portion 16. Beside the winding portion 16 a touch roller 22 is provided for pushing the heat transfer recording sheet 1 against the core 2 in the winding portion 16, and above the discharging portion 17 a terminal roller 23 is provided for attaching the adhesive tape 31 to the sheet roll 26 for terminal processing of sheet roll 26 held in the discharging portion 17, as being movable up and down.

The operation of the present embodiment in the above structure is next explained. As shown in FIG. 3, the weblike heat transfer recording sheet W is first fed out from the supplying apparatus 11, and this heat transfer recording sheet W is sent to the waste sheet part forming apparatus 12. The heat transfer recording sheet W sent to the waste sheet part forming apparatus 12 is cut in the portion corresponding to the region between sheet rolls 26 as described above, and between the heat transfer sheets W thus separated there are a blue lead sheet 32, an adhesive tape 31, a transparent waste sheet 30, an adhesive tape 31, and a blue lead sheet 32 attached to the heat transfer sheets in order from left to right in FIG. 10A. The lead sheets 32, 32 among them are portions to cover the outside of sheet roll 26 or to be first wound around the core 2, but the lead sheets 32, 32 do not always have to be provided. The transparent waste sheet 30 and adhesive tapes 31, 31 compose the waste sheet part.

Next, the weblike heat transfer recording sheet W is cut in the longitudinal direction into plural columns in the slit apparatus 13, and both side portions of the weblike heat transfer recording sheet W are also cut off. Both side portions of the weblike heat transfer recording sheet W are wound by the disposal sheet winding apparatus 21. On the other hand, after the weblike heat transfer recording sheet W is cut in the longitudinal direction into plural columns, it forms heat transfer recording sheets 1, which are sent to the winding apparatus 15.

The operation of the winding apparatus 15 is next described referring to FIG. 4 to FIG. 9. First, FIG. 4 shows a state wherein the winding portion 16 in the winding apparatus 15 has formed a sheet roll 26. On this occasion, the heat transfer recording sheet 1 stops and the waste sheet 30 is located immediately before the touch roller 22. Also, a core 2 not having a roll of heat transfer recording sheet 1 is set in the discharging portion 17.

Figure 5:
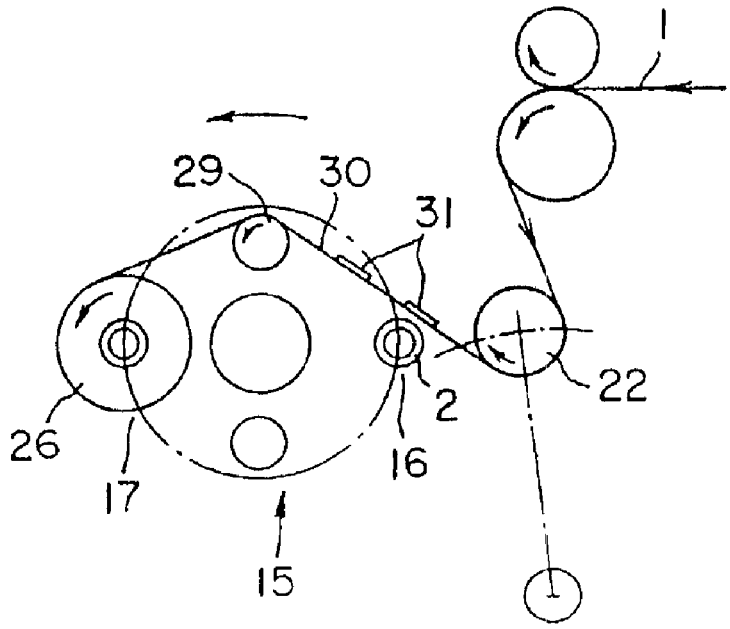
FIG. 5 is a drawing to show the operation of the winding apparatus in the sheet roll producing apparatus.
Figure 6:
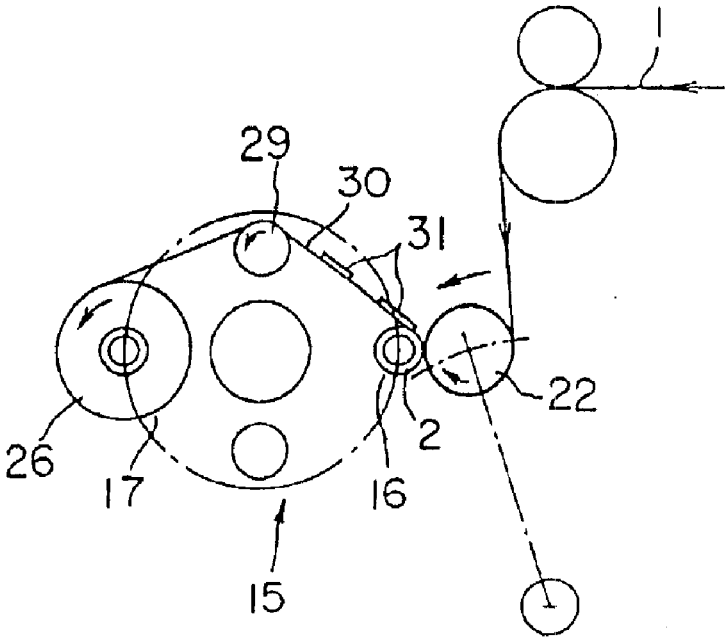
FIG. 6 is a drawing to show the operation of the winding apparatus in the sheet roll producing apparatus.

Next, as shown in FIG. 5, the touch roller 22 leaves the sheet roll 26, and a turret mechanism (not shown) rotates the apparatus 180° to bring the wound sheet roll 26 from the winding portion 16 to the discharging portion 17 and to bring the core 2 from the discharging portion 17 to the winding portion 16. On this occasion, the waste sheet 30 is located between the touch roller 22 and the retaining roller 29. Next, as shown in FIG. 6, the touch roller 22 advances toward the core 2, and the adhesive tape 31 on the upstream side of the waste sheet 30 is located above the core 2.

Figure 7:
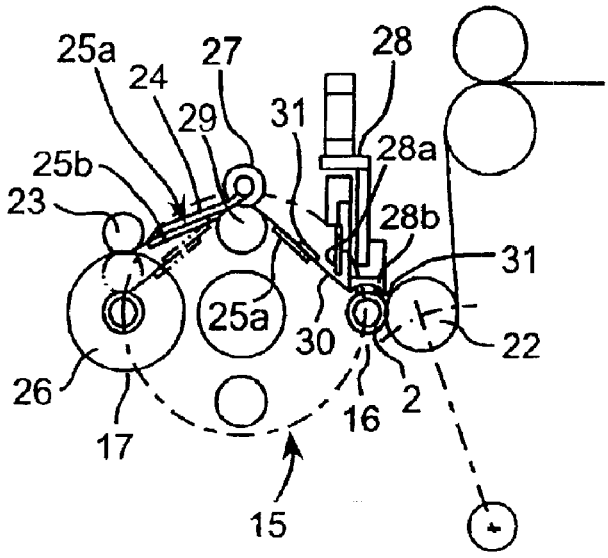
FIG. 7 is a drawing to show the operation of the winding apparatus in the sheet roll producing apparatus.

Next, as shown in FIG. 7, the terminal roller 23 descends to press the sheet roll 26 and the nip roller 27 also descends to pinch the heat transfer recording sheet 1 (or lead sheet 32) between the nip roller 27 and the retaining roller 29. At the same time, the stop plate 24 attached to the nip roller 27 descends to stop the heat transfer recording sheet 1 (or lead sheet 32) between the stop plate 24 and the guide plate 25*b*. Also, the guide plate 25*a* supports the heat transfer recording sheet 1 (or lead sheet 32) between the retaining roller 29 and the winding portion 16.

Figure 8:
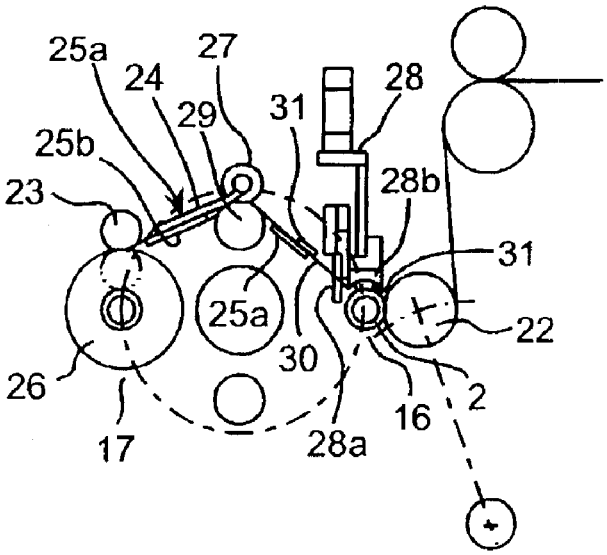
FIG. 8 is a drawing to show the operation of the winding apparatus in the sheet roll producing apparatus.

In this state, the cutting portion 28 descends as shown in FIG. 8 to cut the waste sheet 30 extending between the retaining roller 29 and the core 2 in the winding portion 16 by the cutter 28*a*. At the same time, the adhesive portion 31*a* of the adhesive tape 31 is pressed against the core 2 by the press portion 28*b* provided in the lower part of the cutting portion 28, whereby the adhesive tape 31 on the upstream side of the waste sheet 30 is attached to the core 2. Next, the sheet roll 26 held in the discharging portion 17 rotates, and the terminal roller 23 pushes the adhesive portion 31*a* of the adhesive tape 31 located on the downstream side of the waste sheet 30 to the sheet roll 26 so as to attach the adhesive portion 31*a* to the outer periphery of sheet roll 26. If the lead sheet 32 is interposed between the waste sheet 30 and the heat transfer recording sheet 1, the lead sheet 32 covers the heat transfer recording sheet 1 in the sheet roll 26, and the adhesive tape 31 adheres the end of the lead sheet 32 to the sheet roll 26.

Figure 9:
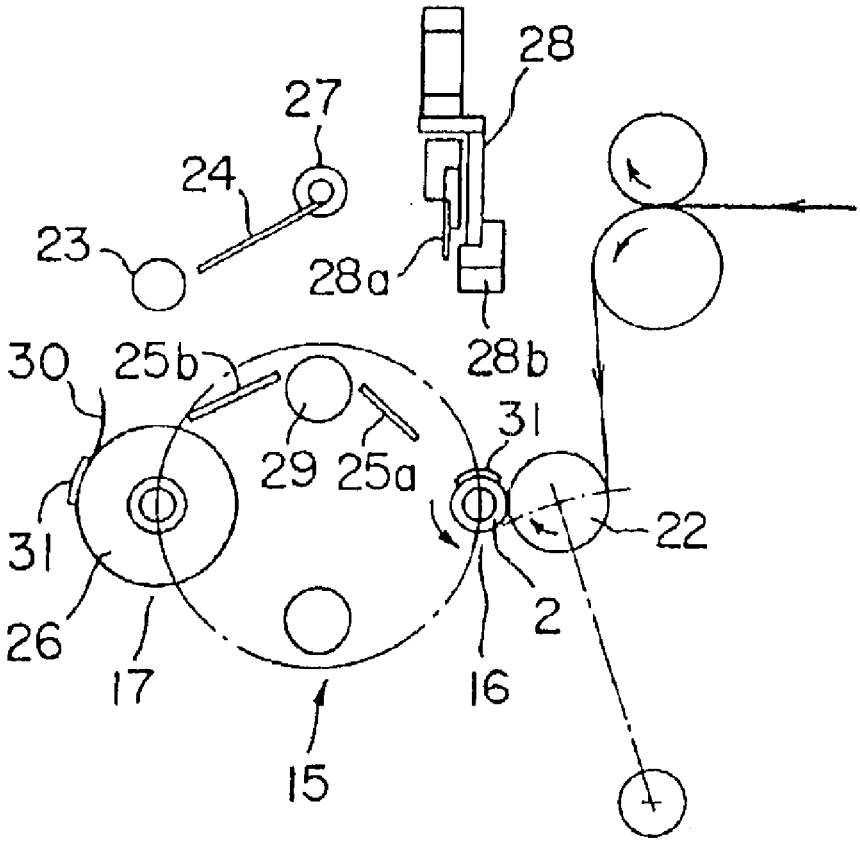
FIG. 9 is a drawing to show the operation of the winding apparatus in the sheet roll producing apparatus.

Next, as shown in FIG. 9, the nip roller 27 with the terminal roller 23 and stop plate 24 attached thereto, and the cutting portion 28 each ascend. Then the core 2 in the winding portion 16 rotates, and with the adhesive sheet 31 attached as a leading end to the core 2, the lead sheet 32 and heat transfer sheet 1 are successively wound around the outer periphery of core 2, thereby forming a sheet roll 26 in the winding portion 16.

As described above, because the present embodiment is so arranged such that the heat transfer recording sheet 1 is cut at a certain point and the pair of adhesive tapes 31 and waste sheet 30 are interposed between the cut ends, the waste sheet 30 is cut so that one adhesive tape 31 is attached to the already wound sheet roll 26 and the other adhesive tape 31 to the core 2, whereby relay of the heat transfer recording sheet 1 can be readily made between the already wound sheet roll 26 and the core.

Sheet Roll Discharging Apparatus and Core Supplying Apparatus

The sheet roll discharging apparatus and core supplying apparatus are next described referring to FIG. 11A to FIG. 22B.

Figure 11A:
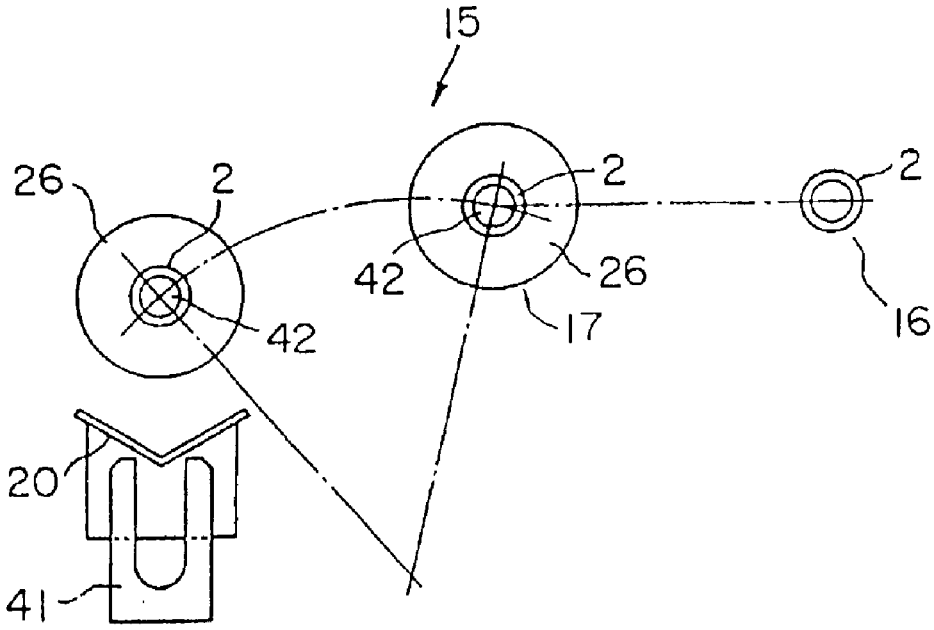
FIGS. 11A and 11B are schematic drawings to show a sheet roll discharging apparatus.
Figure 11B:
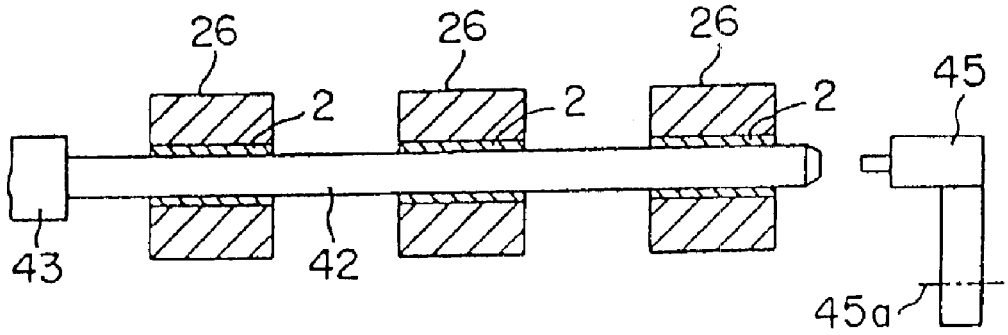

The sheet roll discharging apparatus is first described. As shown in FIG. 11A, the winding apparatus 15 is provided with a cantilever shaft 42 movable from the winding portion 16 to the discharging portion 17, and this cantilever shaft 42 is arranged as further movable to above the discharge tray 20. As shown in FIG. 11B, the cantilever shaft 42 is an air shaft, which increases the diameter thereof when air is supplied to inside thereof, and is arranged to be rotated by a rotation drive portion 43.

Also, as shown in FIG. 11B, above the discharge tray 20 there is a charge and exhaust apparatus 45 for performing charge and exhaust of air into or out of the cantilever shaft 42 when connected to a free end of the cantilever shaft 42. The charge and exhaust apparatus 45 is arranged as movable in the direction of the axis of the cantilever shaft 42 and rotatable about a rotational axis 45*a*.

Figure 12A:
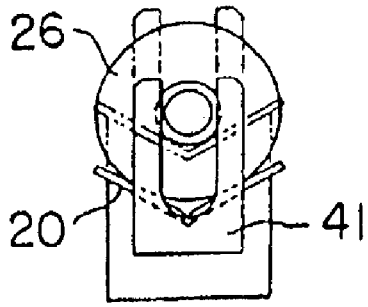
FIGS. 12A and 12B are drawings to show an ascent state of a discharge tray in the sheet roll discharging apparatus.
Figure 12B:
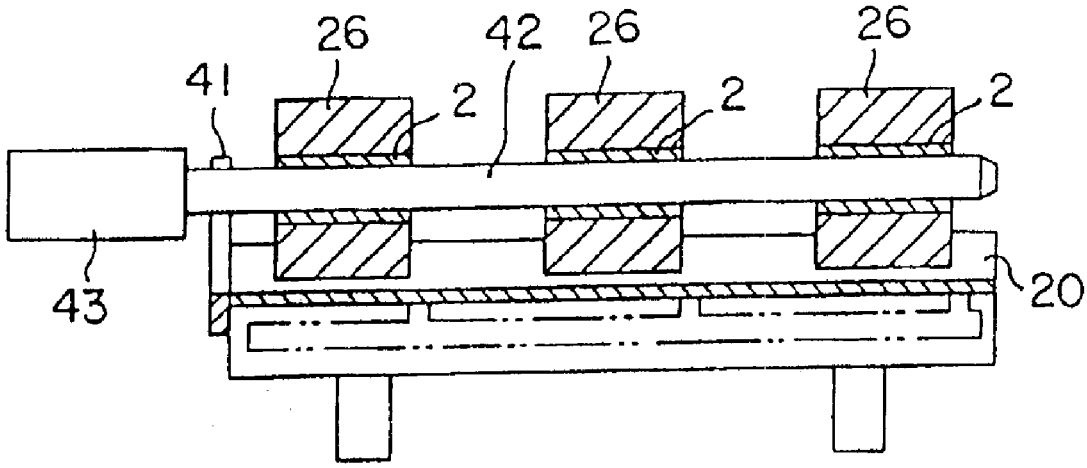

Further, as shown in FIG. 11B, the cantilever shaft 42 supports a plurality of sheet rolls 26 already wound at constant intervals, for example, at equal intervals. The discharge tray 20 shown in FIG. 11A is arranged to receive and support sheet rolls 26, as described previously, and is arranged as movable up and down relative to the cantilever shaft 42 and movable in the direction of the axis of the cantilever shaft 42. Further, a stopper 41 is mounted on the discharge tray 20 so as to be movable up and down. This stopper 41 is inserted on the side of the rotation drive portion 43 of the cantilever shaft 42 to come into contact with the end on the side of the rotation drive portion 43, of the sheet roll 26 closest to the rotation drive portion 43 out of the sheet rolls 26 supported by the cantilever shaft 42 (FIGS. 12A and 12B).

Figure 13:
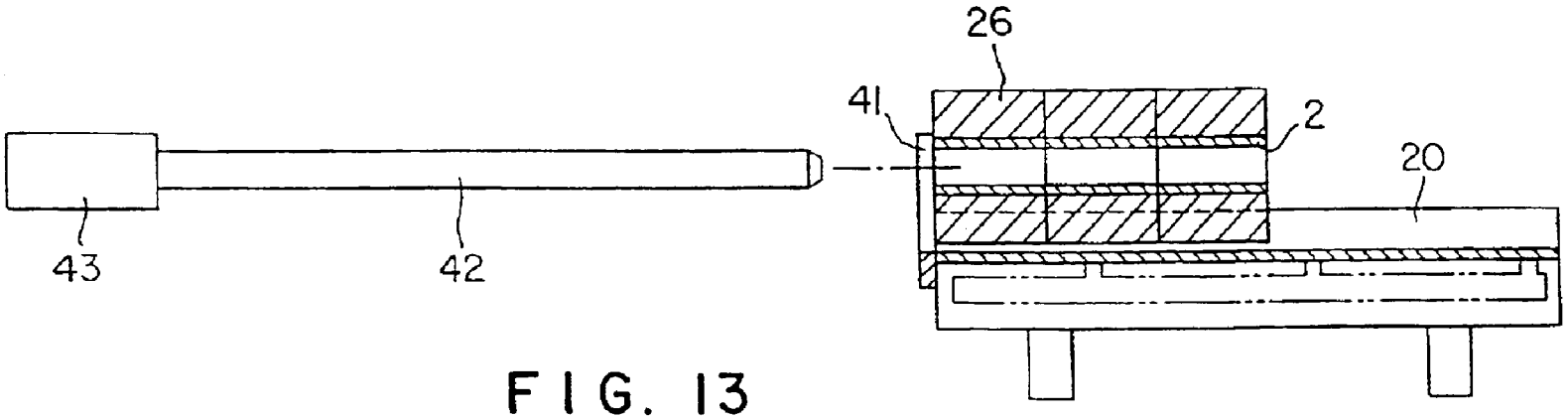
FIG. 13 is a drawing to show a state in which the discharge tray is moving to the right in the sheet roll discharging apparatus.
Figure 14:
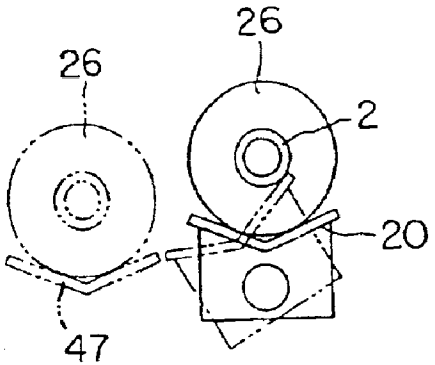
FIG. 14 is a drawing to show a state in which the discharge tray is rocking in the sheet roll discharging apparatus.

Further, as shown in FIG. 13 and FIG. 14, a discharge conveyor 47 is disposed on the free end side of the cantilever shaft 42 (or beside the discharge tray 20 in FIG. 14). After moving to the position shown in FIG. 13, the discharge tray 20 is arranged as rockable so that the sheet rolls 26 on the discharge tray 20 can be transferred onto the discharge conveyor 47 located beside the tray.

Figure 15:
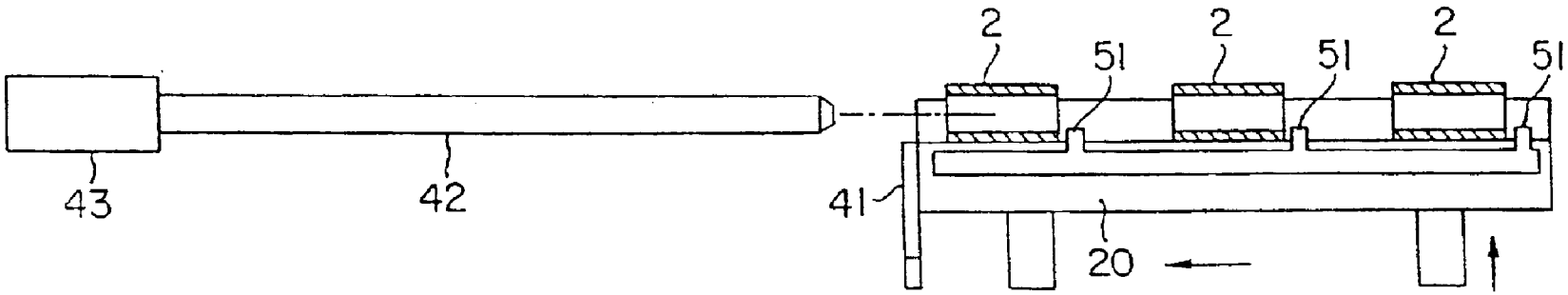
FIG. 15 is a drawing to show a state in which the discharge tray is located on the right side in a core supplying apparatus.
Figure 16:
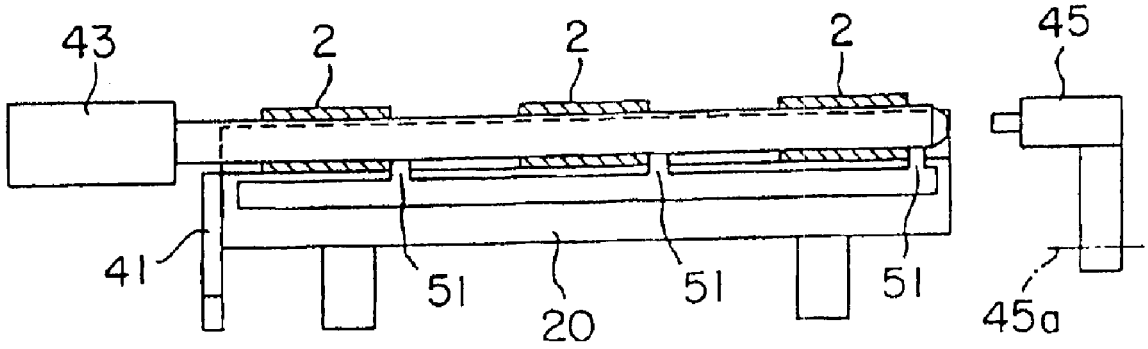
FIG. 16 is a drawing to show a state in which the discharge tray is located immediately below a cantilever shaft in the core supplying apparatus.
Figure 17:
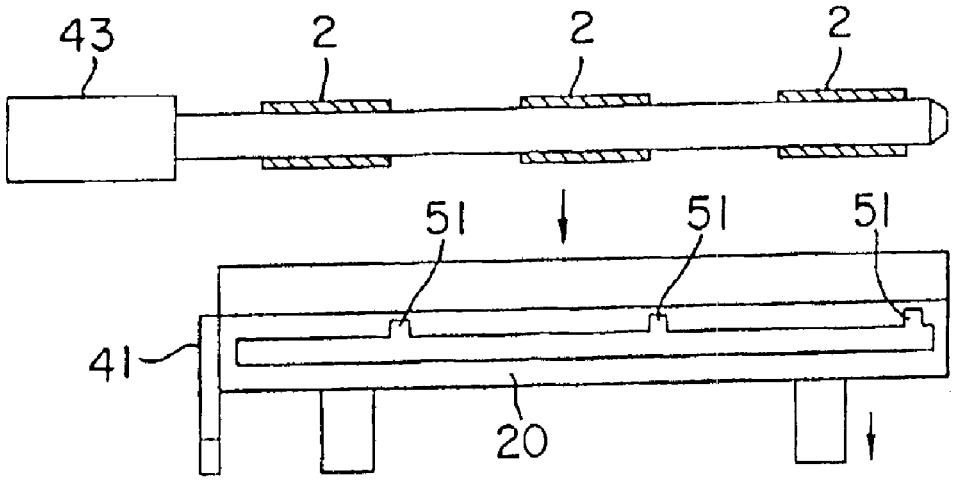
FIG. 17 is a drawing to show a descent state of the discharge tray in the core supplying apparatus.
Figure 18A:
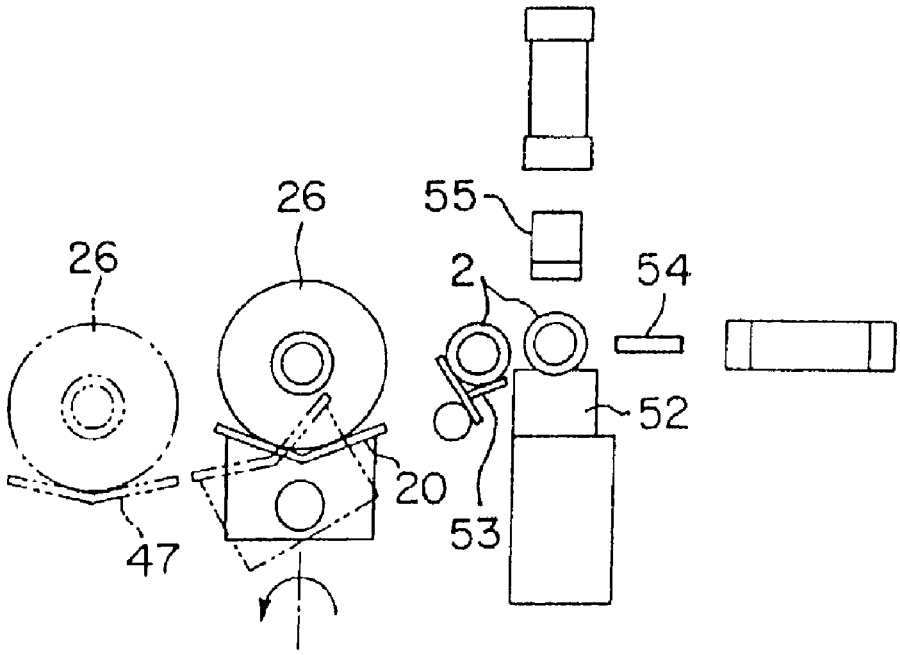
FIGS. 18A and 18B are drawings to show a state in which sheet rolls on discharge trays are being discharged in the core supplying apparatus.
Figure 18B:
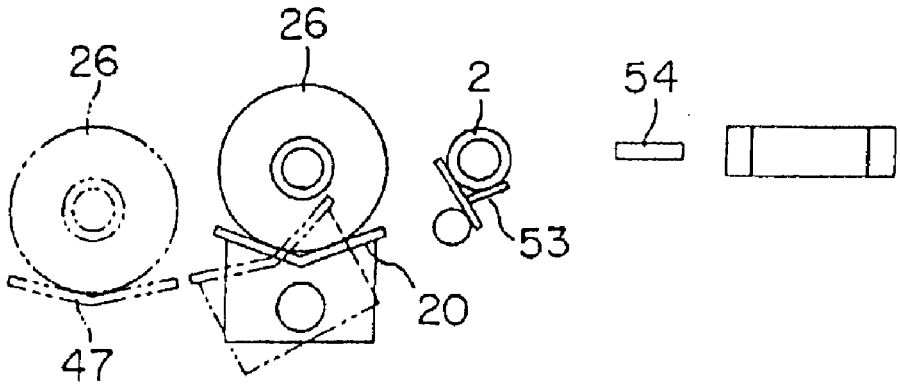

The core supplying apparatus is next described referring to FIG. 15 to FIG. 22B. As shown in FIG. 15 to FIG. 17, the core supplying apparatus is comprised of the aforementioned cantilever shaft 42 having the rotation drive portion 43, and the discharge tray 20 movable up and down relative to the cantilever shaft 42 and movable in the direction of the axis thereof. The cantilever shaft 42 is arranged to support a plurality of cores 2 at predetermined intervals. Also, the discharge tray 20 is so arranged that a plurality of cores 2 can be mounted on the discharge tray 20. Core stoppers 51 are arranged to project at constant intervals (for example, at equal intervals) on a mount surface of the discharge tray 20 and are arranged to push associated cores 2 toward the cantilever shaft 42 when the cores 2 are brought from the free end side onto the cantilever shaft 42.

Also, on the free end side of the cantilever shaft 42 (on the right side of FIG. 15) there is provided a transferring apparatus for transferring the cores 2 to the discharge tray 20 (FIGS. 18A, 18B to FIGS. 22A, 22B). The transferring apparatus has, as shown in FIGS. 18A, 18B to FIGS. 22A, 22B, a core conveyor 52 for conveying the cores 2 in the direction nearly parallel to the axis of the cantilever shaft 42 and bringing the cores 2 to beside the discharge tray 20 moved to the free end side of the cantilever shaft 42, and a core stocker 53 for temporarily stocking the cores 2 conveyed on the core conveyor 52 and feeding the cores 2 to the discharge conveyor 20 moved to the free end side of the cantilever shaft 42.

This core stocker 53 is disposed between the discharge tray 20 moved to the free end side of the cantilever shaft 42 and the core conveyor 52 and is arranged to take a closed state where the core stocker is bent and an open state where the core stocker is stretched. Namely, the core stocker 53 can temporarily stock the cores 2 fed from the core conveyor 52 when the core stocker 53 is in the closed state; it can feed the cores 2 stocked to the discharge tray 20 by natural drop when the core stocker 53 is in the open state.

On the opposite side to the core stocker 53 with respect to the core conveyor 52 there are pushers 54 for pushing the cores 2 on the core conveyor 52 to the core stocker 53. There are a plurality of (three in the present embodiment) pushers 54 arranged at constant intervals in the feed direction of the core conveyor 52.

In FIGS. 18A, 18B to FIGS. 22A, 22B, each figure accompanied with A shows the core supplying apparatus corresponding to the upper-step winding apparatus, and each figure accompanied with B shows the core supplying apparatus corresponding to the lower-step winding apparatus.

The operation of the present embodiment in the above structure is next described. First, as shown in FIG. 3, the weblike heat transfer recording sheet W is drawn out from the supplying apparatus 11, and the heat transfer recording sheet W is sent to the waste sheet part forming apparatus 12. The heat transfer recording sheet W sent to the waste sheet part forming apparatus 12 is cut in the portion corresponding to the region between sheet rolls 26, as described previously, and the transparent waste sheet is attached between the heat transfer recording sheets W after cutting.

Then the weblike heat transfer recording sheet W is cut in the longitudinal direction into plural columns in the slit apparatus 13 and both side portions of the weblike heat transfer recording sheet W are also cut off. Both side portions of the weblike heat transfer recording sheet W are wound by the disposal sheet winding apparatus 21. On the other hand, the weblike heat transfer recording sheet W is cut in the longitudinal direction into plural columns of heat transfer recording sheets 1, which are sent to the winding apparatus 15.

The operation in the winding apparatus 15 is next explained referring to FIG. 11A to FIG. 14. First, as shown in FIGS. 11A and 11B, three cores 2 are supplied to the cantilever shaft 42 to be preliminarily set at constant intervals equivalent to the length of the cores 2, for example at equal intervals. This supply and setting operation of cores 2 will be detailed hereinafter. Then the cantilever shaft 42 with the cores 2 set thereon is located in the winding portion 16 in the winding apparatus 15. In this case, air is supplied into the cantilever shaft 42, so that the diameter of the cantilever shaft 42 increases to firmly keep the cores 2 thereon.

Next, in this winding portion 16, the rotation drive portion 43 rotates the cantilever shaft 42 to wind the heat transfer recording sheets 1 around the outer peripheries of cores 2, thus forming three sheet rolls 26 on the cantilever shaft 42. Next, the cantilever shaft 42 supporting the three sheet rolls 26 moves from the winding portion 16 to the discharging portion 17, the sheet rolls 26 are cut at the rear ends thereof while moving to the discharging portion 17, and the rear ends thus cut are made to adhere to the sheet rolls 26. Then the cantilever shaft 42 supporting the three sheet rolls 26 moves to the position above the discharge tray 20.

Next, as shown in FIG. 11B, the charge and exhaust apparatus 45 connected to the free end of the cantilever shaft 42 evacuates the air inside the cantilever shaft 42 to decrease the diameter of the cantilever shaft 42. After that, the charge and exhaust apparatus 45 leaves the cantilever shaft 42 along the axial direction and then rotates about the rotation axis 45*a* to recede from the axis of shaft 42.

Next, as shown in FIGS. 12A and 12B, the stopper 41 and discharge tray 20 ascend relative to the cantilever shaft 42, so that the stopper 41 comes to be located between the rotation drive portion 43 and the sheet roll 26 on the side of the rotation drive portion 43. Then the stopper 41 and discharge tray 20 move relative to the cantilever shaft 42 to the free end side of the cantilever shaft 42 (to the right in the FIG. 12B). In this case, a small gap is formed between the three sheet rolls 26 and the discharge tray 20, and thus, the stopper 41 can smoothly push the three sheet rolls 26 to the free end side of the cantilever shaft 42.

As the stopper 41 and discharge tray 20 move in this manner further to the right of FIG. 12B away from the free end of the cantilever shaft 42, the sheet rolls 26 are pushed by the stopper 41 to be successively mounted on the discharge tray 20 (FIG. 13). In this case, the three sheet rolls 26 are located at biased positions on the stopper 41 side on the discharge tray 20. When the stopper 41 and discharge tray 20 come to the position shown in FIG. 13, the stopper 41 descends relative to the discharge tray 20 and the discharge tray 20 rocks. In this case, as shown in FIG. 14, the sheet rolls 26 on the discharge tray 20 are transferred onto the discharge conveyor 47 located beside the discharge tray 20. The sheet rolls 26 transferred onto the discharge conveyor 47 are discharged to the outside by the discharge conveyor 47.

As described above, the present embodiment is so arranged such that the already wound sheet rolls 26 supported on the cantilever shaft 42 can readily and surely be transferred from the discharge tray 20 to the discharge conveyor 47 and can readily be discharged to the outside by the discharge conveyor 47.

Next explained referring to FIG. 15 to FIG. 22B is the operation for supplying the cores onto the cantilever shaft 42 and setting them on the shaft. The sheet rolls 26 are drawn from the cantilever shaft 42 and the discharge tray 20 moves to the free end side (the right side of FIG. 15) of the cantilever shaft 42. In this case, the sheet rolls 26 on the upper discharge tray 20 and the sheet rolls 26 on the lower discharge tray 20 are transferred onto the discharge conveyors 47 through the rocking motion of the discharge trays 20. During this period, the upper and lower core stockers 53 are in the closed state, and each core stocker 53 temporarily stocks cores 2. The core conveyor 52 is located beside the upper discharge tray 20.

Figure 19A:
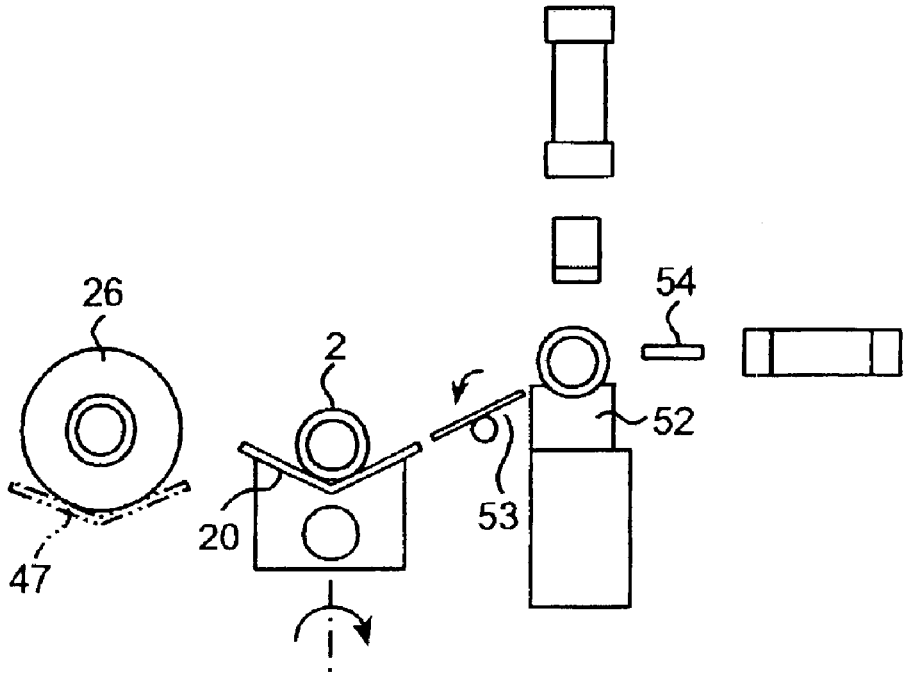
FIGS. 19A and 19B are drawings to show a state in which cores are being fed onto the discharge trays in the core supplying apparatus.
Figure 19B:
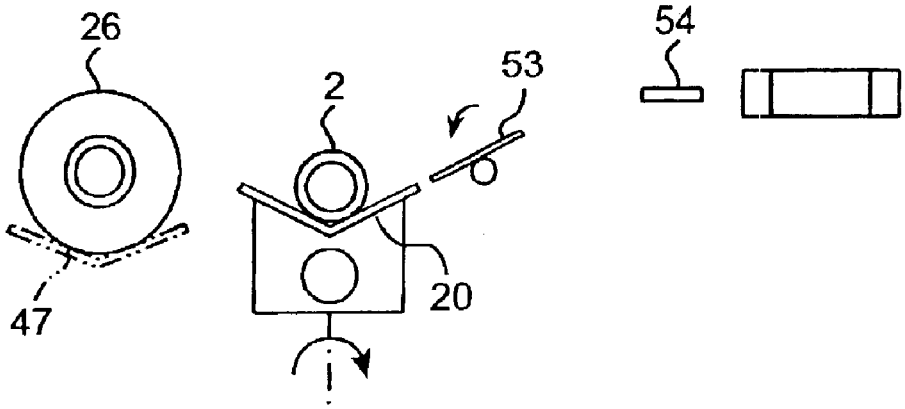

Next, as shown in FIGS. 19A and 19B, the upper and lower discharge trays 20 rock back to the original positions and the core stockers 53 become open to transfer the cores 2, 2 stocked on the respective core stockers 53 onto the discharge trays 20 by natural drop.

Figure 20A:
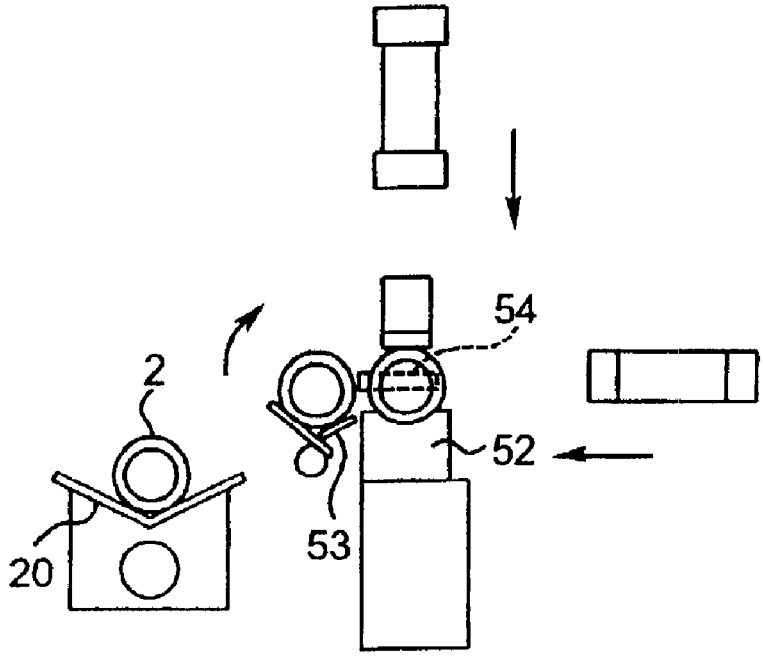
FIGS. 20A and 20B are drawings to show a state in which cores are being fed to core stockers in the core supplying apparatus.
Figure 20B:
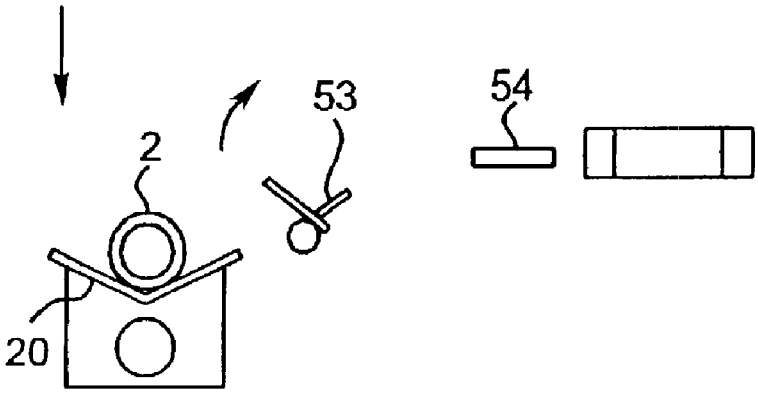

Then, as shown in FIGS. 20A and 20B, the upper and lower core stockers 53 are closed and the cores 2 on the core conveyor 52 located at the upper step are pushed by the plurality of (three in the present embodiment) pushers 54 arranged at constant intervals, in the feed direction of the core conveyor 52 to be temporarily stocked on the core stocker 53.

Figure 21A:
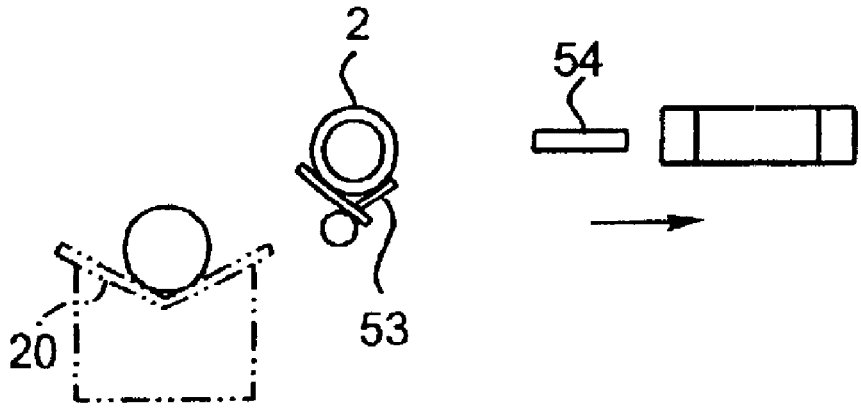
FIGS. 21A and 21B are drawings to show a state in which cores are being fed to the core stockers in the core supplying apparatus.
Figure 21B:
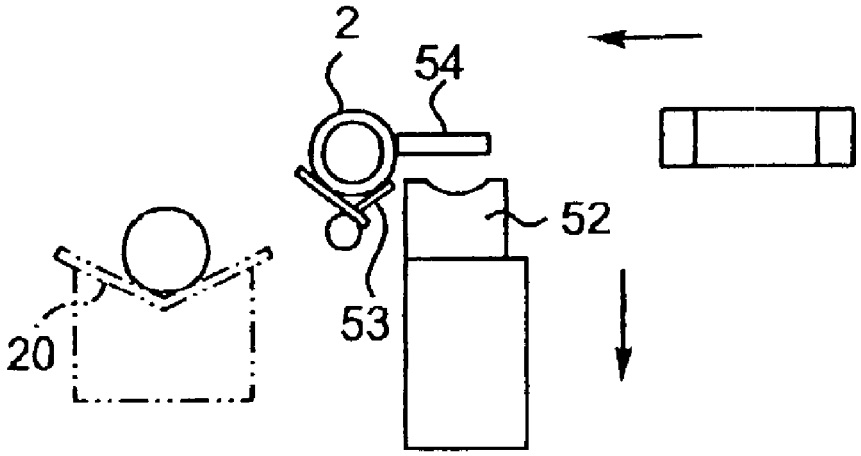
Figure 22A:
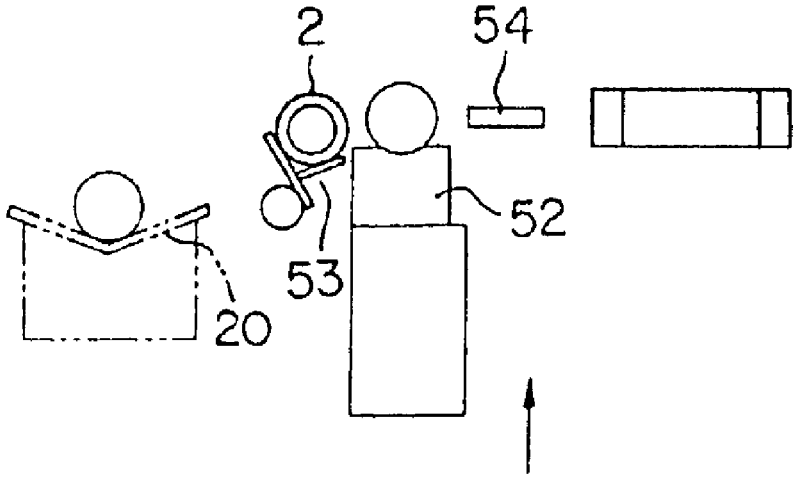
FIGS. 22A and 22B are drawings to show a state in which cores are being fed to the core stockers in the core supplying apparatus.
Figure 22B:
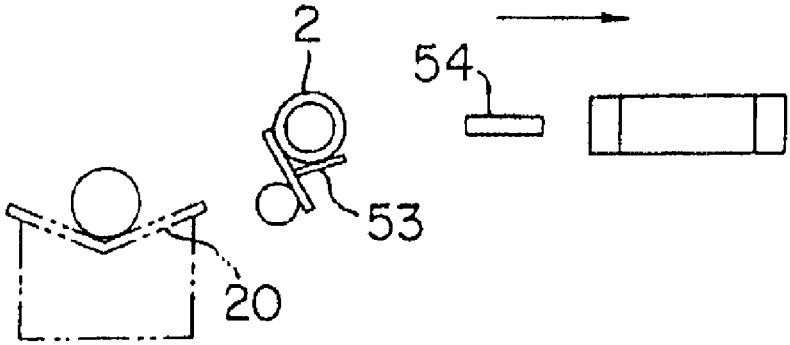

After that, as shown in FIGS. 21A and 21B, the upper pushers 54 move back and the core conveyor 52 descends to be located beside the lower discharge tray 20. Then the cores 2 on the core conveyor 52 are pushed by the pushers 54 to be temporarily stocked on the lower core stocker 53. Thereafter, as shown in FIG. 22A and 22B, the lower pushers 54 move back and the core conveyor 52 ascends.

In this manner three cores 2 are mounted on each of the upper and lower discharge trays 20, as shown in FIG. 15. In this case, the cores 2 each are placed adjacent to the core stoppers 51 on the discharge tray 20.

Next, as shown in FIG. 16, the discharge tray 20 moves to the cantilever shaft 42 in the direction of the axis of the cantilever shaft 42, whereby the three cores 2 mounted on the discharge tray 20 come to fit on the cantilever shaft 42 from the free end thereof. During this period, the cores 2 each are pushed by the core stoppers 51 provided at constant intervals, for example at equal intervals, on the discharge tray 20 and the cores 2 are positioned with good accuracy on the cantilever shaft 42, whereby the cores 2 are arranged at equal intervals on the cantilever shaft 42. Then the charge and exhaust apparatus 45 supplies the air into the cantilever shaft 42 to increase the diameter of cantilever shaft 42, whereby the cantilever shaft 42 firmly holds the cores 2.

Then, as shown in FIG. 17, the discharge tray 20 moves downward relative to the cantilever shaft 42, thereby completing the setting operation of cores 2 on the cantilever shaft 42.

As described above, according to the present embodiment, a plurality of cores 2 can readily and surely be supplied to the cantilever shaft 42, using the discharge tray 20, and the cores 2 can be set on the cantilever shaft 42 as being positioned with accuracy.

As detailed above, according to the present invention, as set forth in claim 1, a plurality of cores can readily and simply be supplied to the cantilever shaft, using the tray, and the cores can accurately be set at constant intervals on the cantilever shaft by the core stoppers. Thus, production of sheet rolls can be perfectly automated.

According to the present invention, the waste sheet part extending between the winding portion and the discharging portion is cut by the cutting portion, the downstream adhesive portion is stuck to the outer periphery of the roll sheet in the discharging portion, and the upstream adhesive portion is stuck to the outer periphery of the core, whereby relay of the heat transfer recording sheet can be facilitated between the sheet roll already wound and the core. This assures secure automation in producing a lot of sheet rolls.

What is claimed is:

1. A multilayer sheet comprising:

at least two heat transfer recording sheets;

at least two first adhesive tapes;

at least two lead sheets;

a waste sheet; and at least two second adhesive tapes, wherein (1) one of the lead sheets is located on but does not overlap one of the heat transfer recording sheets, (2) another of the lead sheets is located on but does not overlap another of the heat transfer recording sheets, (3) the waste sheet is aligned with the lead sheets but separated therefrom, (4) the first adhesive tapes are located on the waste sheet and the lead sheets to attach the waste sheet to the lead sheets, (5) one of the second adhesive tapes is located on one of the heat transfer recording sheets and one of the lead sheets to attach the heat transfer recording sheet to the lead sheet, and (6) another one of the second adhesive tapes is located on another of the heat recording sheet and another of the lead sheets to attach the heat transfer recording sheet to the lead sheet.

2. The multilayer sheet of claim 1, wherein the heat transfer recording sheets are weblike.

3. The multilayer sheet of claim 1, wherein the waste sheet is transparent.

* * * * *